US010220970B2

(12) United States Patent
Lemieux et al.

(10) Patent No.: US 10,220,970 B2
(45) Date of Patent: Mar. 5, 2019

(54) APPARATUSES FOR WRAPPING A LOAD AND SUPPLYING FILM FOR WRAPPING A LOAD AND ASSOCIATED METHODS

(71) Applicant: Wulftec International Inc., Ayer's Cliff (CA)

(72) Inventors: Pascal Lemieux, Sherbrooke (CA); Ivaylo Brankov, Sherbrooke (CA); Éric Dubreuil, Coaticook (CA); Sylvain Samson, Ayer's Cliff (CA); Guy Lopes, Sherbrooke (CA)

(73) Assignee: Wulftec International Inc., Ayer's Cliff, QC (CA)

( * ) Notice: Subject to any disclaimer, the term of this patent is extended or adjusted under 35 U.S.C. 154(b) by 420 days.

(21) Appl. No.: 15/048,616

(22) Filed: Feb. 19, 2016

(65) Prior Publication Data

US 2016/0167812 A1 Jun. 16, 2016

Related U.S. Application Data

(62) Division of application No. 13/912,908, filed on Jun. 7, 2013, now Pat. No. 9,944,417.

(60) Provisional application No. 61/657,189, filed on Jun. 8, 2012.

(51) Int. Cl.
*B65B 11/04* (2006.01)
*B65B 59/00* (2006.01)

(52) U.S. Cl.
CPC ..... *B65B 11/045* (2013.01); *B65B 59/00* (2013.01); *B65B 2210/04* (2013.01)

(58) Field of Classification Search
CPC ..... B65B 11/045
USPC ..... 53/465
See application file for complete search history.

(56) References Cited

U.S. PATENT DOCUMENTS

| | | | |
|---|---|---|---|
| 3,910,005 | A | 10/1975 | Thimon et al. |
| 4,302,920 | A | 12/1981 | Lancaster |
| 4,387,548 | A | 6/1983 | Lancaster |
| 4,429,514 | A | 2/1984 | Lancaster et al. |
| 4,458,467 | A | 7/1984 | Shulman et al. |
| 4,545,182 | A | 10/1985 | McDowell |

(Continued)

FOREIGN PATENT DOCUMENTS

| | | | |
|---|---|---|---|
| CA | 2603981 | A1 | 10/2006 |
| CA | 2758148 | A1 | 10/2006 |

(Continued)

*Primary Examiner* — Andrew M Tecco
*Assistant Examiner* — Praachi M Pathak
(74) *Attorney, Agent, or Firm* — Wiley Rein LLP

(57) ABSTRACT

A wrapping apparatus, its components, and corresponding methods for wrapping a load in packaging material are described herein. The apparatus has a packaging material dispenser having a frame and a plurality of packaging material supplies. The apparatus also has a load press for wrapping an upper surface of the load, where the load press has a central press section and a peripheral press section which can disengage the upper surface to allow wrapping of at least a part thereof. The apparatus also has an enclosure to prevent access during operation, as well as a packaging material seeking assembly which seeks out the packaging material to be wrapped. The apparatus and methods described allow for an automatic wrapping of a load which minimizes operator intervention, and further allow for the automatic resupply of packaging material.

9 Claims, 7 Drawing Sheets

(56) References Cited

U.S. PATENT DOCUMENTS 4,553,376 A 11/1985 Okada et al.
4,674,269 A 6/1987 Denda
4,726,172 A 2/1988 Widenbäck
5,123,230 A 6/1992 Upmann
5,301,493 A 4/1994 Chen
5,311,725 A 5/1994 Martin
5,414,979 A 5/1995 Moore
5,603,198 A 2/1997 Rimondi et al.
5,623,808 A * 4/1997 Franklin ..... B65B 11/025 53/399
5,634,321 A 6/1997 Martin-Cocher et al.
5,768,862 A 6/1998 Mauro
5,797,246 A 8/1998 Martin-Cocher et al.
5,829,234 A 11/1998 Suolahti
5,836,140 A 11/1998 Lancaster
5,893,258 A * 4/1999 Lancaster, III ..... B65B 11/045 414/907
5,941,049 A 8/1999 Lancaster, III et al.
6,085,488 A 7/2000 Turfan et al.
6,151,863 A 11/2000 Lancaster et al.
6,185,900 B1 2/2001 Martin et al.
6,269,610 B1 8/2001 Lancaster et al.
6,293,074 B1 9/2001 Lancaster et al.
6,539,690 B2 4/2003 Alvarez
6,550,222 B2 * 4/2003 DeGrasse ..... B65B 11/045 53/399
6,594,970 B1 * 7/2003 Hyne ..... B65B 11/025 53/399
D481,049 S 10/2003 Limousin
6,658,820 B2 12/2003 Whitby et al.
6,713,010 B1 3/2004 Doran et al.
6,739,115 B1 5/2004 Malini
6,748,718 B2 6/2004 Lancaster et al.
6,772,573 B2 8/2004 Federeszyn
6,772,575 B2 8/2004 Limousin
6,817,163 B2 11/2004 Limousin
6,826,893 B2 12/2004 Cere
6,834,826 B2 12/2004 Nobuta et al.
6,848,237 B2 2/2005 Lancaster et al.
6,848,240 B2 2/2005 Frey
6,854,247 B2 2/2005 Lancaster et al.
6,880,316 B2 4/2005 Lancaster et al.
6,883,293 B2 4/2005 Lancaster et al.
6,918,229 B2 7/2005 Lancaster et al.
6,925,778 B2 8/2005 Suolahti
7,047,707 B2 5/2006 Lancaster et al.
7,080,495 B2 7/2006 Suolahti
7,089,713 B2 8/2006 Lancaster et al.
7,114,308 B2 10/2006 Cox
7,137,233 B2 11/2006 DeGrasse et al.
7,143,569 B2 12/2006 Limousin
7,469,520 B2 12/2008 Lancaster et al.
7,540,128 B2 6/2009 Lancaster et al.
7,568,327 B2 8/2009 Lancaster et al.
7,581,368 B1 9/2009 Bison
7,607,277 B2 10/2009 Tsuchiya et al.
7,707,801 B2 5/2010 Lancaster
7,707,901 B2 5/2010 Lancaster et al.
7,779,607 B2 8/2010 Lancaster et al.
7,861,497 B2 * 1/2011 Lardinois ..... B65B 11/006 53/176
8,145,350 B2 3/2012 Lancaster et al.
8,272,196 B2 9/2012 Limousin
8,276,346 B2 10/2012 Lancaster et al.
8,474,233 B2 7/2013 Lancaster et al.
2002/0056253 A1 5/2002 DeGrasse et al.
2002/0174628 A1 11/2002 Lancaster et al.
2004/0146390 A1 7/2004 Lancaster et al.
2005/0138897 A1 6/2005 Lancaster et al.
2006/0254225 A1 11/2006 Lancaster
2007/0157557 A1 7/2007 Lancaster
2007/0204565 A1 9/2007 Lancaster
2007/0209327 A1 9/2007 Kent
2008/0209859 A1 9/2008 Vanderheiden et al.
2008/0229707 A1 9/2008 Zitella et al.
2008/0229716 A1 9/2008 Zitella et al.
2009/0178374 A1 7/2009 Lancaster et al.
2009/0235617 A1 9/2009 Moore et al.
2009/0293435 A1 12/2009 Johnson et al.
2010/0239403 A1 9/2010 Lancaster et al.
2010/0313525 A1 12/2010 Martin et al.
2011/0131927 A1 6/2011 Lancaster et al.
2011/0179752 A1 7/2011 Lancaster et al.
2012/0102881 A1 5/2012 Moore et al.
2012/0102886 A1 5/2012 Lancaster
2012/0102887 A1 5/2012 Lancaster et al.
2012/0174533 A1 7/2012 Lancaster
2012/0175170 A1 7/2012 Martin et al.
2013/0076753 A1 3/2013 Lancaster et al.
2013/0326999 A1 12/2013 Lemieux et al.

FOREIGN PATENT DOCUMENTS

DE 3634924 A1 4/1988
DE 4234604 A1 4/1994
EP 0246659 A1 11/1987
NL 1028770 C2 11/2006
WO 9822346 A1 5/1998
WO 2006110596 A1 10/2006
WO 2009120681 A1 10/2009
WO 2011057166 A2 5/2011

* cited by examiner

APPARATUSES FOR WRAPPING A LOAD AND SUPPLYING FILM FOR WRAPPING A LOAD AND ASSOCIATED METHODS

RELATED APPLICATION

This application is a divisional of U.S. patent application Ser. No. 13/912,908 filed Jun. 7, 2013, now pending, which claims the benefit of U.S. Provisional Application No. 61/657,189 filed on Jun. 8, 2012 and entitled "APPARATUSES FOR WRAPPING A LOAD AND SUPPLYING FILM FOR WRAPPING A LOAD AND ASSOCIATED METHODS". The foregoing applications are incorporated herein by reference in their entireties.

TECHNICAL FIELD OF THE INVENTION

The technical field relates to a wrapping apparatus for wrapping a load with a packaging material, and more particularly, to a wrapping apparatus having a film delivery assembly. It also relates to a method for wrapping a load and delivering a film for wrapping a load.

BACKGROUND

Wrapping apparatuses have been developed to stretch, dispense, and wrap stretch packaging material around a load. The four vertical sides of the load are typically covers with a stretchable packaging material (or film) such as polyethylene packaging material. Stretch wrapping can be accomplished by a turntable, a rotating arm, a vertical rotating ring, or a horizontal rotating ring wherein relative rotation is provided between the load and a packaging material dispenser to wrap packaging material about the sides of the load.

Loads are continuously packaged in the wrapping apparatus until the packaging material supply mounted to the packaging material dispenser is emptied. Then, the packaging material dispenser must be reloaded with a new packaging material supply. Alternatively, even if the packaging material dispenser is not emptied, there may be a need to change the packaging material, for instance, to wrap a load with a packaging material having different properties. For reloading the packaging material dispenser with a new packaging material supply or changing the packaging material, an operator must enter the wrap zone and, consequently, energy has to be removed from the apparatus. Furthermore, when the wrapping apparatus is restarted, energy has to be restored beforehand. There is thus a downtime period associated with either reloading the packaging material dispenser or changing the packaging material.

Furthermore, in some applications, there might be a need to at least partially wrap an upper surface of the load. However, when using a turntable to provide relative rotation between the load and the packaging material dispenser, pressure must be applied on the load upper surface to prevent the latter from being ejected from the turntable due to the centrifugal force. There is thus a need to apply pressure on the upper surface of the load to prevent load ejection from the turntable or displacement of the load during rotation and simultaneously allow at least a portion of the upper surface to be covered by the packaging material.

BRIEF SUMMARY OF THE INVENTION

It is therefore an aim of the present invention to address the above mentioned issues.

According to a general aspect, there is provided a packaging material dispenser for a wrapping apparatus comprising: a frame having at least a first packaging material supply and a second packaging material supply, the frame being selectively configurable into at least a first configuration wherein the first packaging material supply is positioned in a packaging material dispensing configuration and a second configuration wherein the second packaging material supply is positioned in the packaging material dispensing configuration.

In an embodiment, the frame is rotatably mounted.

In an embodiment, the wrapping apparatus comprises a turntable and the frame of the packaging material dispenser is spaced-apart from the turntable.

In an embodiment, each of the at least first packaging material supply and second packaging material supply comprises a roll support for supporting a roll of packaging material to be dispensed.

In an embodiment, each of the at least first packaging material supply and second packaging material supply comprises a starting clamp assembly having two spaced-apart grips, the starting clamp assembly configured for sizing and holding a portion of the packaging material between the spaced-apart grips when configured in an inoperative configuration.

In an embodiment, at least one of the at least first packaging material supply and second packaging material supply is slidably mounted to the frame so as to be vertically displaced along the frame.

In an embodiment, the at least first packaging material supply and second packaging material supply is displaced from the packaging material dispensing configuration upon the at least first packaging material supply and second packaging material supply being depleted of packaging material or a different type of packaging material being required.

According to another general aspect, there is provided a packaging wrapping apparatus for wrapping a load having an upper surface comprising a load press having: a central press section being configurable in an operative configuration wherein the central press section abuts the upper surface of the load and in a disengaged configuration wherein the central press section is spaced-apart from the load; and a peripheral press section at least partially surrounding the central press section and configurable in an operative configuration wherein the peripheral press section abuts the upper surface of the load and in a disengaged configuration wherein the peripheral press section is spaced-apart from the load; the central press section and the peripheral press section being independently configurable in the operative and disengaged configurations.

In an embodiment, the load press further comprises a frame extending above the upper surface of the load and at least one main actuator mounted to the frame and operatively connected to at least one of the central press section and the peripheral press section for configuring the at least one of the central press section and the peripheral press section in the operative and disengaged configurations. The at least one main actuator can operatively be connected to the central press section and can be actuable for selectively configuring the central press section in the operative and disengaged configurations.

In an embodiment, the load press further comprises a peripheral press actuator connecting the central press section and the peripheral press section together and actuable for selectively configuring the peripheral press section in the operative and disengaged configurations when the central press section is configured in the operative configuration. The peripheral press actuator can actuate the peripheral press section in the disengaged configuration, thereby spacing the peripheral press section apart from the upper surface of the load, and can further actuate the central press section in the operative configuration while the upper surface of the load is at least partially wrapped.

According to still another general aspect, there is provided a packaging method for wrapping a load comprising: clamping a section of a packaging material supplied by a packaging material supply mounted to a packaging material dispenser in a packaging material dispensing configuration; moving the clamped section of the packaging material from the packaging material dispenser towards the load; and wrapping the load with the packaging material.

In an embodiment, wrapping the load comprises rotating the load about itself.

According to a further general aspect, there is provided a packaging wrapping apparatus comprising: a load support frame; a packaging material dispenser having at least one packaging material supply configurable in a packaging material dispensing configuration; and a packaging material seeking assembly having a packaging material clamp displaceable between the packaging material dispenser and the load support frame for sizing a packaging material supplied by one of the at least one packaging material supply configured in a packaging material dispensing configuration.

In an embodiment, the packaging material dispenser comprises a starting clamp assembly having two spaced-apart grips, the starting clamp assembly transferring the packaging material to the packaging material clamp in the packaging material dispensing configuration.

In an embodiment, the packaging material clamp comprises two displaceable legs operable between an open configuration wherein the legs move away from each other so as to receive the packaging material, and a closed configuration wherein the legs are displaced towards each other so as to clamp the packaging material there between.

In an embodiment, the packaging material clamp further comprises a displacement mechanism for displacing the packaging material clamp between the packaging material dispenser and the load support frame.

In an embodiment, the load support frame comprises a turntable and at least one conveyor for transporting a load toward and away from the turntable.

In an embodiment, the packaging material clamp is displaced towards the turntable and rotated therewith.

In an embodiment, the wrapping apparatus further comprises an enclosure enclosing an area containing at least in part the load support frame, the packaging material seeking assembly, and the packaging material dispenser, the enclosure comprising a plurality of openings for permitting access to the area. The enclosure can comprise a plurality of mechanical barriers and a plurality of light curtains defining the openings permitting access to the area. In an embodiment, at least two of the light curtains are oppositely disposed across one of the openings, the two light curtains cooperating so as to create a light curtain barrier across said opening and configured for operating between an active configuration wherein crossing of the light curtain barrier result in shutdown of operation of the wrapping apparatus, and an inactive configuration wherein crossing of the light curtain barrier results in continued operation of the wrapping apparatus.

According to a further general aspect, there is provided a method for wrapping an upper surface of a load comprising: configuring a central press section and a peripheral press section in an operative configuration wherein the central press section and the peripheral press section abut the upper surface of the load; wrapping a first section of the load; configuring the peripheral press section in a disengaged configuration wherein the peripheral press section is spaced-apart from at least a part of the upper surface of the load; and wrapping a second section of the load, the second section including at least a part of the upper surface of the load.

In an embodiment, the method further comprises sizing the section of the packaging material prior to clamping the section of packaging material.

In an embodiment, wrapping the load further comprises juxtaposing a free end of the packaging material to the load and rotating the load.

In an embodiment, the method further comprises providing a plurality of packaging material supplies on the packaging material dispenser; selecting one of the packaging material supplies; and configuring the selected one of the packaging material supplies in the packaging material dispensing configuration before clamping the section of the packaging material. Configuring the selected one of the packaging material supplies can comprise rotating the selected one of the packaging material supplies until it is in the packaging material dispensing configuration.

In an embodiment, the method further comprises clamping a new section of the packaging material after wrapping the load so as to separate the packaging material from the load.

According to a further general aspect, there is provide a method for preventing access to a wrapping apparatus comprising: defining a secure area about at least a part of the wrapping apparatus, the secure area comprising openings for permitting access thereto; securing the secure area with a plurality of mechanical barriers and a plurality of light curtains; defining a plurality of barriers with the light curtains selectively configurable in an active configuration and an inactive configuration; and selectively shutting down operation of the wrapping apparatus upon at least one barrier in the active configuration being crossed.

In an embodiment, the method further comprises defining at least one of the barriers across a corresponding one of the openings.

In an embodiment, the method further comprises positioning two light curtains oppositely across one of the openings so as to define a corresponding barrier across said opening.

In an embodiment, selectively shutting down operation of the wrapping apparatus comprises selectively configuring the at least one barrier between the active configuration wherein crossing of the at least one barrier results in shutdown of operation of the wrapping apparatus, and the inactive configuration wherein crossing of the at least one barrier results in continued operation of the wrapping apparatus.

In an embodiment, the light curtain barriers comprise a first set of light curtain barriers and a second set of light curtain barriers, selectively configurable in the active configuration, the first set being configured in the active configuration and the second set being configured in the inactive configuration upon operation of the wrapping apparatus allowing access to a packaging material dispenser and preventing access to the wrapping apparatus. The first set can be configured in the inactive configuration and the second set can be configured in the active configuration upon rotation of the packaging material dispenser to prevent access thereto.

In this specification, the terms "packaging material", "film", "web", and "film web" are interchangeable.

The present document refers to a number of documents, the contents of which are hereby incorporated by reference in their entirety.

BRIEF DESCRIPTION OF THE DRAWINGS

It will be noted that throughout the appended drawings, like features are identified by like reference numerals.

DETAILED DESCRIPTION

Figure 1:
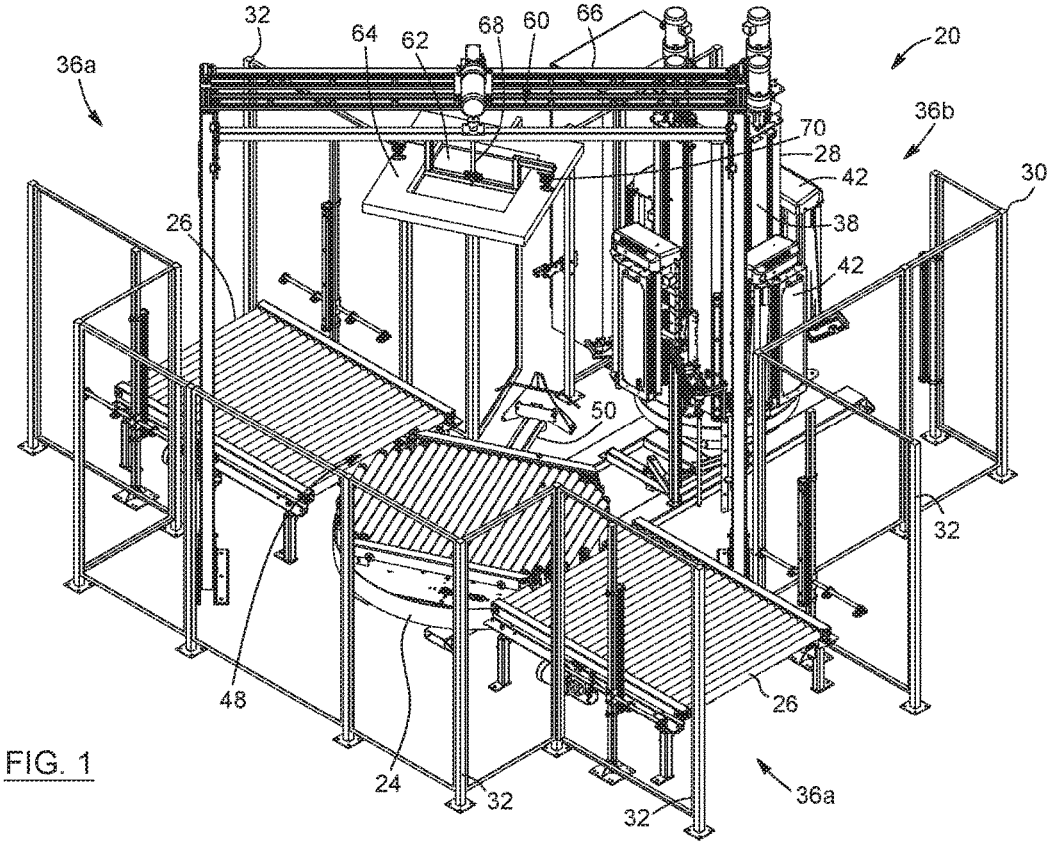
FIG. 1 is a perspective view of a wrapping apparatus in accordance with an embodiment.
Figure 2:
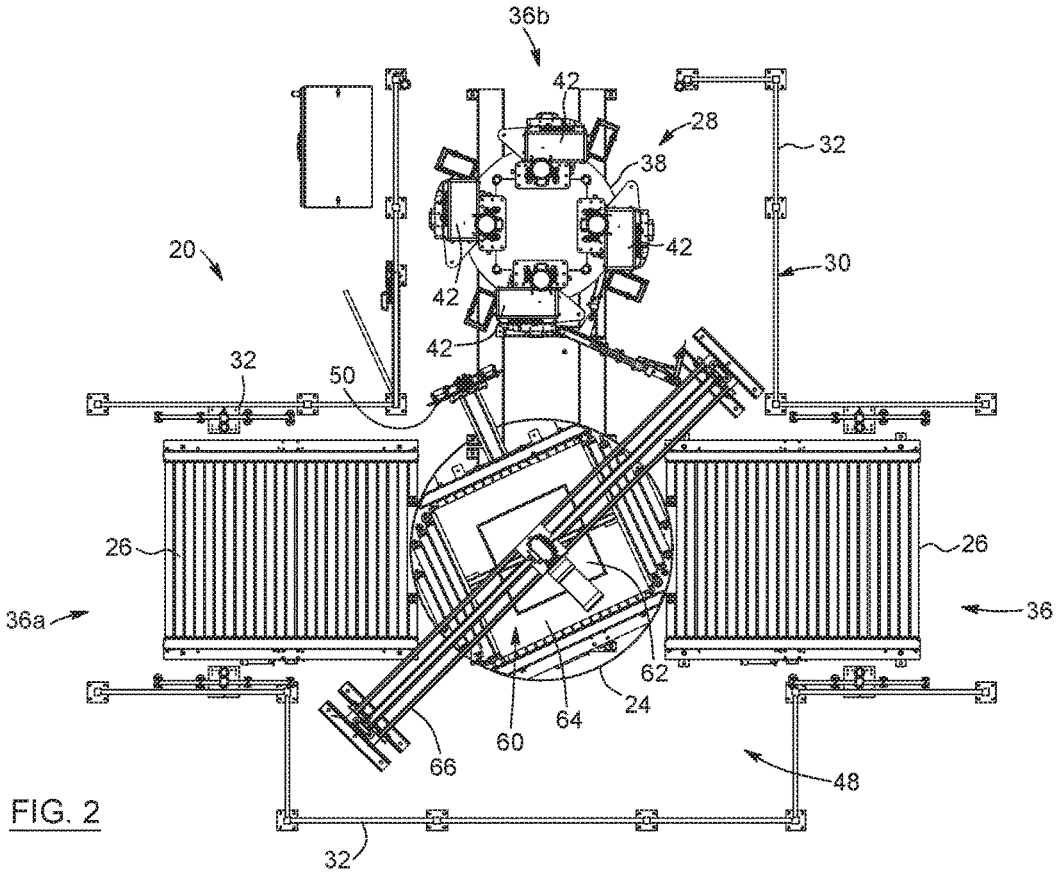
FIG. 2 is a top plan view of the wrapping apparatus shown in FIG. 1.

Referring now to the drawings and, more particularly, referring now to FIGS. 1 and 2, there is shown an embodiment of a wrapping apparatus 20 for wrapping a load (not shown). The wrapping apparatus 20 includes a turntable 24, as a load support frame, extending between two conveyors 26 for carrying the loads to the turntable 24 for being wrapped (upstream conveyor) and removing the loads from the turntable 24 when wrapped (downstream conveyor) with a packaging material. The apparatus 20 further includes a packaging material dispenser 28, spaced-apart from the turntable 24, for dispensing the packaging material for wrapping the loads on the turntable 24. In the embodiment shown, the packaging material is a polymeric film dispensed in a web form and the packing material dispenser 28 includes a plurality of pre-stretch assemblies configured to pre-stretch the wrapping polymeric film, as it will be described in more detail below.

The turntable 24 and both conveyors 26 define together a longitudinal axis of the apparatus 20. The packaging material dispenser 28 is aligned with the turntable 24; but defines therewith a transversal axis, substantially perpendicular to the longitudinal axis. In other words, the packaging material dispenser 28 is not aligned with the conveyors 26.

Relative rotation between the load and the packaging material dispenser 28 is provided to wrap the packaging material around the load. In the embodiment shown, the load is mounted on the turntable 24, which rotates about a hub (not shown).

One skilled in the art will appreciate that the relative rotation between the load and the packaging material dispenser 28 can be provided by other means than the turntable assembly shown in the accompanying drawings. For instance and without being limitative, the apparatus 20 can include a horizontal rotatable ring assembly, a vertical rotatable ring assembly, or a rotating arm assembly, each having a load support frame supporting the load while it is wrapped.

The apparatus 20, including the turntable 24, the conveyors 26, and the packaging material dispenser 28, is surrounded by an enclosure 30 which safeguards personnel in the vicinity of the apparatus 20, and prevents them from accessing the apparatus 20 during its operation. The enclosure 30 defines a wrap zone 48 of the apparatus 20, which is an area delimited by the enclosure 30 in which wrapping occurs. The enclosure 30 can be a combination of mechanical (i.e. physical) barriers 32, and light curtains 34 or zone scanners, as it will be described in more detail below. The light curtains 34 or zone scanners are opto-electronic devices and, more particularly, presence detection devices. They can emit a signal or control upon detecting the presence of an individual during operation of the apparatus 20, thereby shutting down the apparatus 20.

One skilled in the art will appreciate that the configuration of the enclosure including its mechanical (physical) barriers 32 and light curtains 34 can differ from the embodiment shown.

Openings 36*a* are provided in the mechanical enclosure 32 at an upstream end of the upstream conveyor 26 and at a downstream end of the downstream conveyor 26 to allow respectively introduction and removal of the loads. A third opening 36*b* is provided in the mechanical enclosure 32 at a distal end (away from the turntable 24) of the section surrounding the packaging material dispenser 28. As it will be described in more detail below, this opening 36*b* includes light curtains 34 which act as safeguards, and shutdown operation of the apparatus 20 if the presence of an individual is detected. One skilled in the art will appreciate that, in an alternative embodiment, opening 36*b* can be located to face an adjacent side of the packaging material dispenser 28.

The packaging material dispenser 28 includes a vertically elongated frame 38. The frame 38 is rotatably mounted and can rotate around a hub (not shown). The packaging material dispenser 28 is a turret system, i.e. a rotating device, holding a plurality of packaging material rolls 25, as it will be described in more detail below.

For supporting the packaging material rolls 25, the packaging material dispenser 28 further includes a plurality of packaging material supplies 42 (referred to herein as "roll carriages" 42) slidably mounted on the frame 38. The roll carriages 42 provide a supply of the packaging material. In the embodiment shown, the packaging material dispenser 28 includes four roll carriages 42, the roll carriages 42 being slidably mounted to the frame 38 in opposed pairs. Each one of the roll carriages 42 can be displaced vertically between a raised position and a lowered position. The vertical movement of each one of the roll carriages 42 can be independent from the other roll carriages 42.

In an alternative embodiment (not shown), one skilled in the art will appreciate that the roll carriages 42 can be replaced by stationary supplies of the packaging material, i.e. ones that are not vertically translatable.

The turret system of the packaging material dispenser 28 allows multiple roll carriages 42 to be pre-loaded with rolls 25 of packaging material. It further allows specific rolls of packaging material to be brought to a packaging material dispensing configuration. The packaging material dispensing configuration refers to the displacement, typically by rotation, and arrival of the packaging material dispenser 28 at a position adjacent to and facing the turntable 24. In such a configuration, the packaging material dispenser 28 is ready to dispense the packaging material. The other packaging material dispenser(s) are then configured in an inoperative configuration. In an alternative embodiment (not shown), the packaging material dispensing configuration can differ from the one shown and described in the present embodiment.

In the embodiment shown, the packaging material dispenser 28 includes four roll carriages 42. However, one skilled in the art will appreciate that the packaging material dispenser 28 can contain one or more roll carriages 42 and, in an embodiment, a plurality of roll carriages 42.

Figure 3:
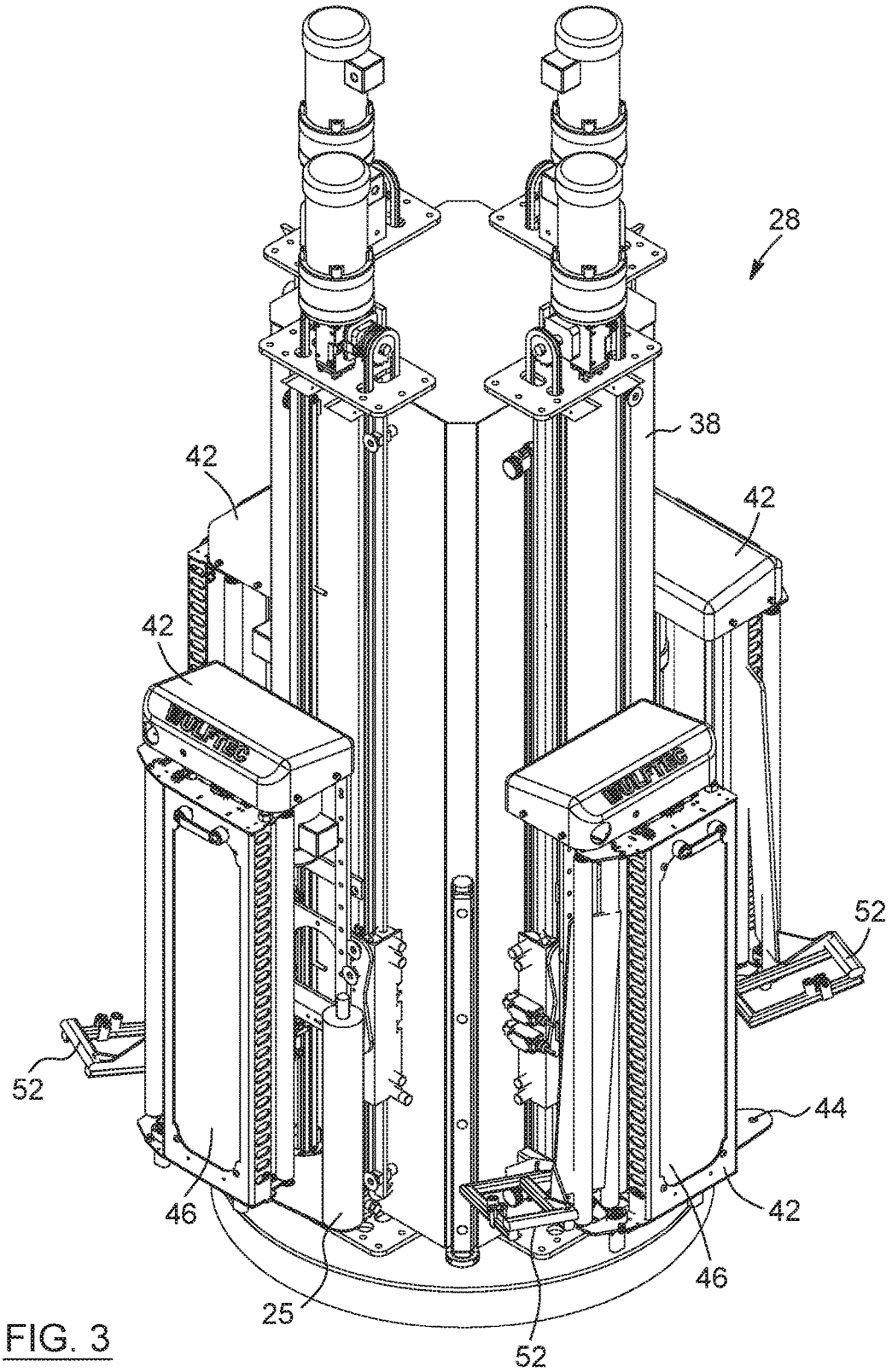
FIG. 3 is a perspective view of a packaging material dispensing assembly of the wrapping apparatus shown in FIG. 1 in accordance with an embodiment.
Figure 4:
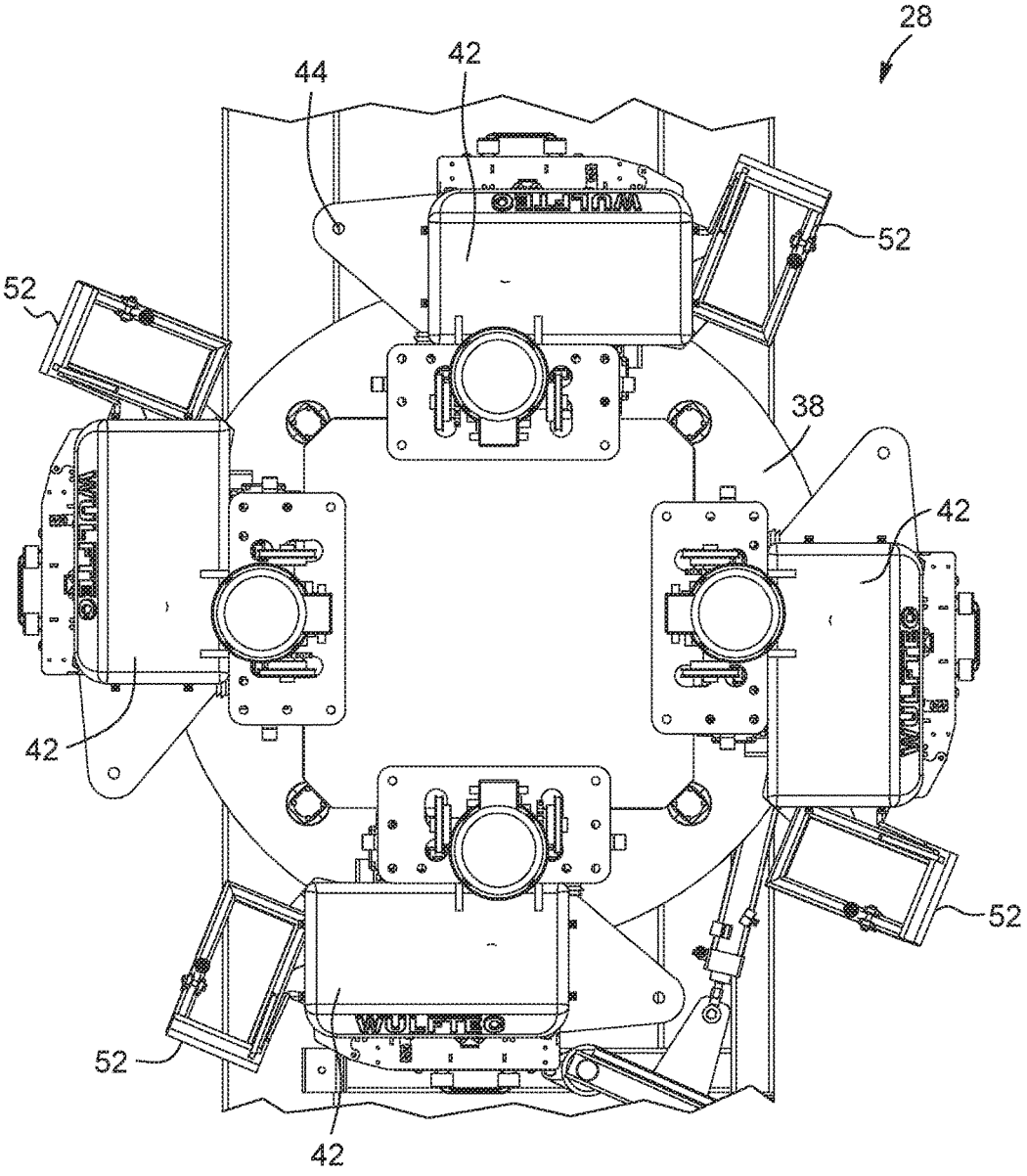
FIG. 4 is a top plan view of the packaging material dispensing assembly shown in FIG. 3.

The configuration of the roll carriages 42 of the packaging material dispenser 28 can differ from the embodiment shown. In the non-limitative embodiment shown in FIGS. 3 and 4, the roll carriages 42 include a roll support 44 for supporting a roll of packaging material to be dispensed. The roll support 44 is constructed to rotatably support a roll 25 of packaging material as it unwinds. The roll carriages 42 further include a pre-stretch assembly 46. As the roll 25 of packaging material unwinds, the packaging material moves from the roll 25 to the pre-stretch assembly 46.

The packaging material is supplied from one of the roll carriages 42 to the load for wrapping same. More particularly, the packaging material is supplied from the roll carriage 42 which is in the packaging material dispensing configuration described above. As the turntable 24 rotates, the packaging material is wrapped around the load. The packaging material is supplied by the roll carriage 42 currently in the packaging material dispensing configuration, which corresponds to the roll carriage 42 which is adjacent to the turntable 24 and opposed to the opening 36*b*. Since the roll carriages 42 are mounted to a rotatable frame 38, the packaging material can be supplied from anyone of the roll carriages 42. For supplying packaging material from a different roll carriage 42, the frame 38 is rotated until the desired roll carriage 42 is in the packaging material dispensing configuration, i.e. adjacent to the turntable 24.

One skilled in the art will appreciate that different mechanisms can be used to rotate the packaging material dispenser 28. Furthermore, the configuration, size, and shape of the packaging material dispenser 28 including its roll carriages 42 can differ from the embodiment shown.

Thus, once the roll 25 of packaging material mounted to one of the roll carriages 42 is depleted, the roll carriage 42 can be reloaded with a new roll 25 of packaging material without interrupting the operation of the apparatus 20 or the wrapping cycle for a relatively long period of time. More particularly, when a roll 25 of packaging material (e.g. film) on one of the roll carriages 42 is empty, the emptied roll carriage 42 can be displaced so as to be positioned adjacent to the opening 36*b*. This displacement, typically by rotation, and positioning of the empty roll carriage 42 adjacent to the opening 36*b* places the empty roll carriage 42 in a reloading configuration. Once in the reloading configuration, the empty roll carriage 42 is ready to be reloaded by an operator with one or more rolls 25 of packaging material. It can thus be appreciated that an operator does not need to enter the secure wrap zone 48 to reload a roll 25 of packaging material. The turret system described herein can further advantageously be programmed to cycle out empty roll carriages 42, and can be indexed automatically whenever a new roll 25 of packaging material is required. Such a configuration of the apparatus greatly reduces, and may even eliminate, the need for human intervention to remove depleted rolls 25 of packaging material, thereby greatly reducing the downtime caused by energy removal and restoration. The operator can safely reload a roll 25 of packaging material on the carriage 42 that is "outside" the area delimited by the enclosure 30 (or the secure area) without causing downtime of the wrapping apparatus 20.

Furthermore, the packaging material dispenser 28 can include different types of packaging materials mounted thereto, i.e. at least two of the roll carriages 42 can have packaging material rolls 25 with different properties. Therefore, it is possible to select the roll carriage 42 for supplying packaging material based on the properties of the packaging material supported by the roll carriage 42.

In other words, each roll carriage 42 can support a different type of packaging material (thickness, size, color, specification) and the apparatus 20 or its operator can index the apparatus 20 so as to select the desired film. If the machine automatically indexes the suitable packaging material, the selection is based on a programmed recipe.

Figure 5:
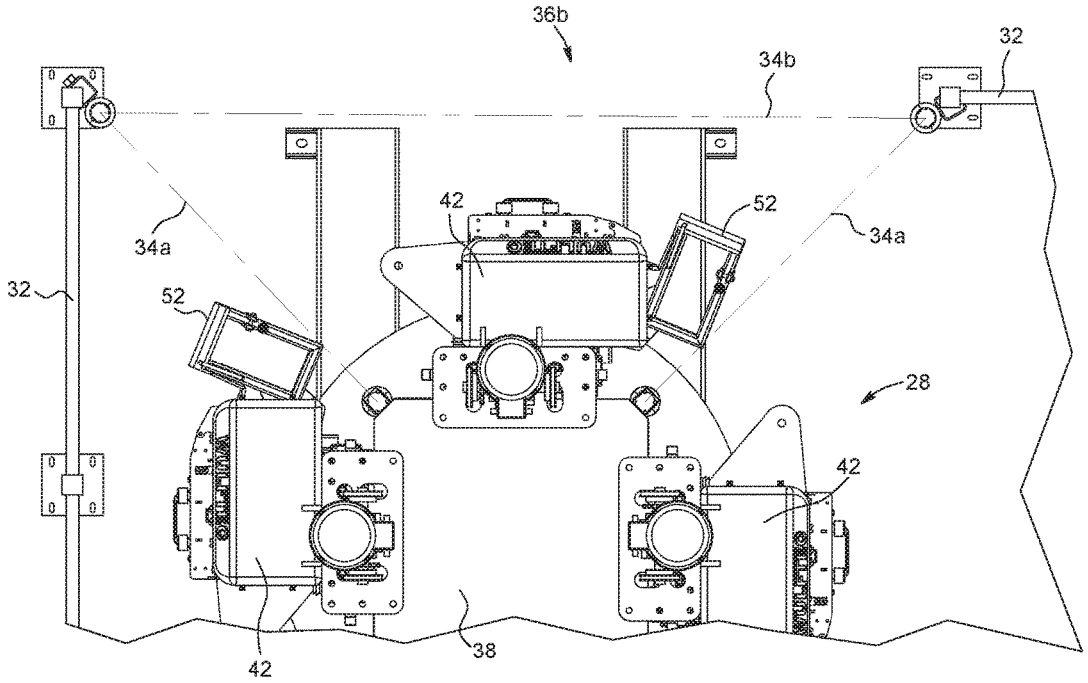
FIG. 5 is a top plan view, partly sectioned, of the packaging material dispensing assembly shown in FIG. 3 showing light curtain barriers in accordance with an embodiment.

Referring to FIG. 5, there is shown the barriers 32 and light curtains 34 or zone scanners provided near the opening 36*b* which can be accessed by the operators for reloading the rolls 25 of packaging material. More particularly, the opening 36*b* permits access to the roll carriage 42 when it is positioned in the packaging material reloading configuration described above. Items 34*a* and 34*b* are both light curtain barriers, light beams, or zone scanners. During operation of the wrapping apparatus 20 (i.e. while loads are being wrapped on the turntable 24), the light curtains 34*a* are active while the light curtains 34*b* are inactive. The term "active" refers to the tendency of a given light curtain to shut down the apparatus 20 if the barrier it creates is crossed. Similarly, the term "inactive" refers to deactivation of a given light curtain so as to permit access to a given area without affecting operation of the apparatus 20. For example, when light curtains 34*a* are active, the operator cannot cross them or he risks shutting down operation of the apparatus 20. However, in the optional configuration shown in FIG. 5, the operator can cross into the area between light curtains 34*a* because light curtain 34*b* is inactive. This configuration of light curtains 34*b*, 34*a* allows the operators to cross into the opening 36*b* and interact with the packaging material dispenser 28 for reloading the roll carriage 42 positioned in the packaging material reloading configuration, even while the apparatus 20 is wrapping the load. The integrity of the secure area delimited by the light barriers 34*a* is thus not disturbed.

When the packaging material dispenser 28 needs to be indexed (i.e. when rotation of the packaging material dispenser 28 is required), the light curtains 34*a* are made inactive, and the light curtain 34*b* is activated, thereby protecting the area surrounding the packaging material dispenser 28 and preventing the operator from crossing into opening 36*b*. When the rotation of the packaging material dispenser 28 is completed, the light curtains 34*a* are again activated and the light curtain 34*b* is made inactive, allowing the operator to interact with the roll carriage 42 adjacent to the opening 36*b*. The light curtains 34*a* or zone scanners can be installed under the turret to monitor the secure areas.

One skilled in the art will appreciate that other safety systems can be designed.

Figure 6:
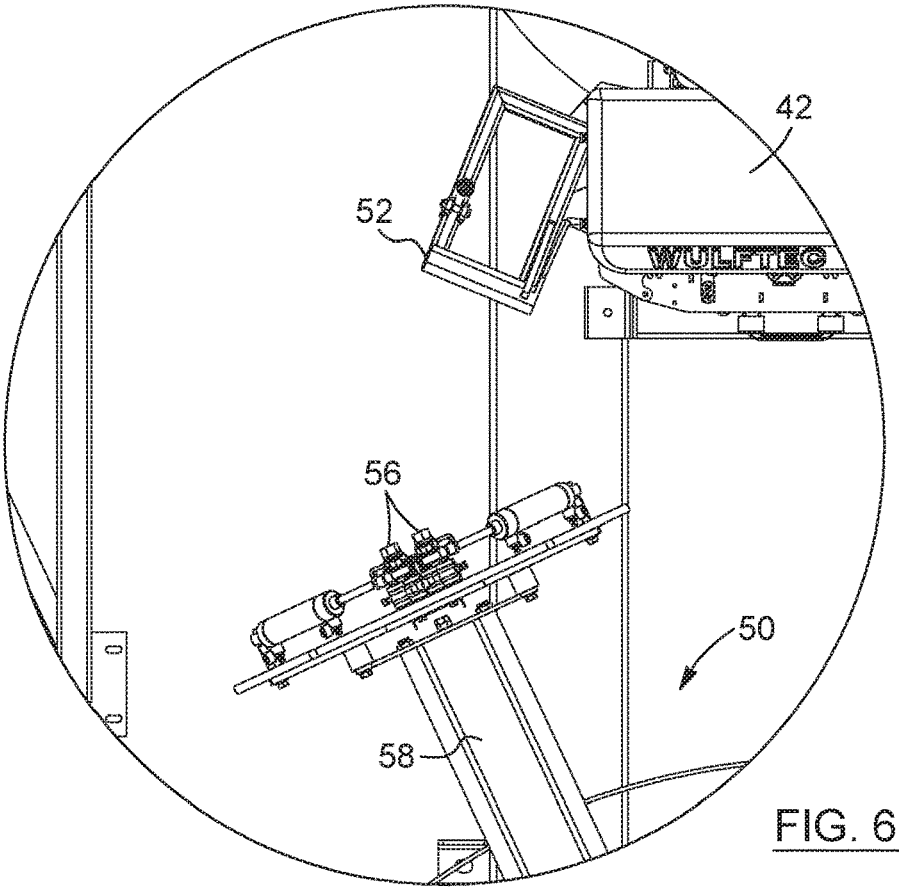
FIG. 6 is a top plan view of a packaging material seeking clamp of the wrapping apparatus shown in FIG. 1 in accordance with an embodiment.
Figure 7:
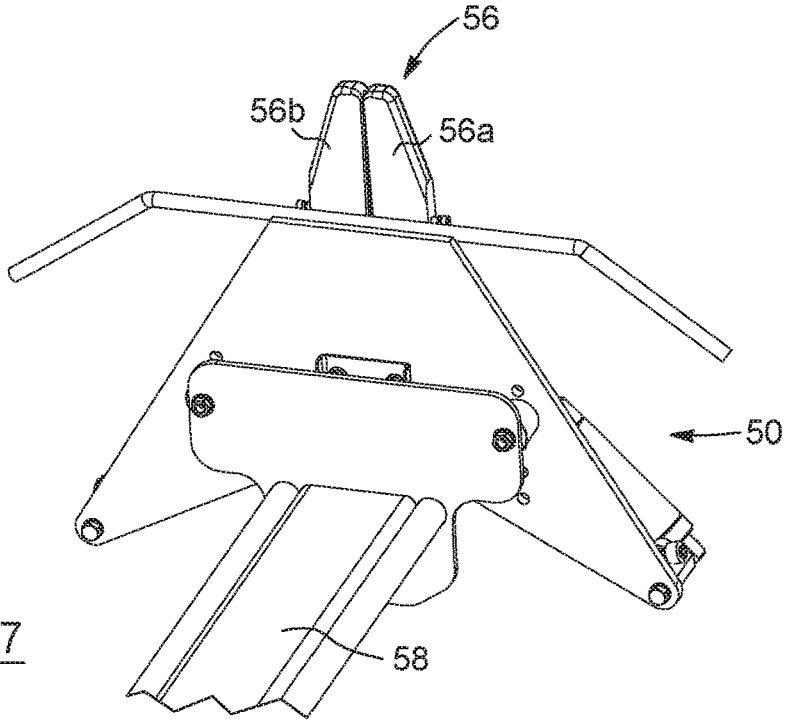
FIG. 7 is a perspective view of the packaging material seeking clamp shown in FIG. 6.

Referring now to FIGS. 6 and 7, there is shown that the wrapping apparatus 20 is also provided with a clamp assembly 50 (or packaging material changeover clamp) which seeks out the packaging material to be wrapped, and which is configured for clamping the packaging material from a roll 25, and bringing the clamped packaging material from the roll carriage 42 to the turntable 24, and vice-versa. There is thus provided clamp assembly 50 which takes and brings the packaging material from the roll carriage 42 to the turntable 24. Such an operation may be necessary whenever there is a need to change the packaging material being used, or when there is a lack of packaging material. Advantageously, no operator intervention is required.

Each one of the roll carriages 42 includes a starting clamp assembly 52 having two spaced-apart grips. When loading a new roll 25 of packaging material into one of the roll carriages 42, the operator positions a tail of the packaging material into the starting clamp assembly 52.

The clamp assembly 50 includes a packaging material clamp 56 operatively connected to a displacement mechanism 58 for displacing the packaging material clamp 56 from the turntable 24 to the packaging material dispenser 28, and vice-versa. In the embodiment shown, the displacement mechanism 58 includes a translatable arm. More particularly, the displacement mechanism 58 displaces the packaging material clamp 56 in a packaging material seeking configuration. The packaging material seeking configuration refers to the displacement of the packaging material clamp 56 from the turntable 24 to a position near to a roll carriage 42, which is itself in the dispensing configuration described above. In one possible embodiment of the packaging material seeking configuration, the displacement mechanism 58 extends the packaging material clamp 56 from a position near the turntable 24, to a position away from the turntable 24 and toward the packaging material dispenser 28. This places the packaging material clamp 56 in a position to receive packing material from the roll carriage 42.

The packaging material clamp 56 comprises two displaceable legs 56*a*,56*b* which are operable between an open configuration where the legs 56*a*,56*b* move away from one another so as to receive the packaging material therein, and a closed configuration where the legs 56*a*,56*b* are displaced towards each other so as to clamp the packaging material placed between them.

In order to size and grip the packaging material tail already secured by the starting clamp assembly 52, the packaging material clamp 56 is displaced and positioned near the packaging material dispenser 28 as per the packaging material seeking configuration described above. At the beginning of the packaging material seeking configuration, the legs 56*a*,56*b* of the packaging material clamp 56 are in the opened configuration, and the tail of the packaging material is held by the starting clamp assembly 52. Then, the two spaced-apart clamps of the starting clamp assembly 52 are opened to release the packaging material into the opened legs 56*a*,56*b* of the packaging material clamp 56, which are then transitioned to the closed configuration so as to grip and secure the tail of the packaging material within the packaging material clamp 56. The clamp assembly 50 is then displaced towards the turntable 24 and away from the packaging material dispenser 28, via the displacement mechanism 58, for example. The clamp assembly 50 thus enters into a wrapping configuration for wrapping the load, as will now be described.

The wrapping configuration relates to the wrapping of the load. In one example of such a configuration, the clamp assembly 50, which now contains a tail of the packaging material, is withdrawn towards the turntable 24. The packaging material thus spans between the turntable 24 (more specifically, the clamp assembly 50) and the packaging material dispenser 28 (more specifically, the packaging material roll 25). Therefore, the packaging material can be spun off the packaging material roll 25 as more packaging material is needed. The turntable 24 is then rotated. Since the clamp assembly 50 has been withdrawn toward the turntable 24 and forms a part thereof, the clamp assembly 50 rotates along with the turntable 24. This rotation of the clamp assembly 50 causes the packaging material to be wrapped around the load, and further causes additional packaging material to be unfurled from the packaging material roll 25.

After a certain number of rotations, the clamp assembly 50 can release the tail of the packaging material it held because the load has now been sufficiently wrapped with packaging material. After the rotations have ceased, the clamp assembly 50 can again be used to sever the connection of packaging material which now unites both the wrapped load and the packaging material roll 25. The clamp assembly 50 achieves this by cutting the packaging material and gripping a new tail of packaging material it has just cut. Therefore, the clamp assembly 50, which is still gripping the new tail of packaging material, is ready to be rotated in the next wrapping cycle.

When a packaging material change is required, the packaging material clamp 56 is displaced towards the packaging material dispenser 28, in the packaging material seeking configuration discussed above, and positioned close to the roll carriage 42, which is in a dispensing configuration, i.e. adjacent to the turntable 24. The spaced-apart clamps of the starting clamp assembly 52 are positioned on each side of the packaging material clamp 56 and are closed, and the packaging material is held by the packaging material clamp 56. The legs 56*a*,56*b* of the packaging material clamp 56 are displaced into the open configuration for releasing the packaging material, which is then held by the starting clamp assembly 52.

Then, the packaging material dispenser 28 is rotated until a selected one of the roll carriages 42 is configured in the dispensing configuration, i.e. it is adjacent to the turntable 24. Then, the same steps are carried out, as detailed above, for sizing the packaging material held by the starting clamp assembly 52 of the selected roll carriage 42, and displacing it towards the turntable 24.

In an alternative embodiment, before rotating the packaging material dispenser 28, the packaging material clamp 56, disengaged from the packaging material, can be displaced towards the turntable 24, i.e. in the wrapping configuration. The packaging material clamp 56 is displaced, once again, towards the packaging material dispenser 28, in the packaging material seeking configuration, when the selected roll carriage 42 is configured in the dispensing configuration, i.e. adjacent to the turntable 24.

When a packaging material roll 25 is emptied, the packaging material dispenser 28 is rotated until the selected roll carriage 42 is configured in the dispensing configuration discussed above. Then, the packaging material clamp 56 is displaced towards the packaging material dispenser 28 and the same steps are carried out, as detailed above, for sizing the packaging material, held by the starting clamp assembly 52 of the selected roll carriage 42, and displacing it towards the turntable 24.

Thus, the apparatus 20 enables the packaging material (e.g. a film) to be brought from the roll support 44 of the roll carriage 42 to the turntable 24, or vice-versa, without operator intervention. This enables the packaging material dispenser 28 (i.e. turret system) to index to the next roll carriage 42 and reload the packaging material into the clamp assembly 50 automatically without the involvement of an operator.

One skilled in the art will appreciate that the starting clamp assembly and the displacement mechanism can differ from the embodiment shown in the attached drawings and described herein.

Figure 8:
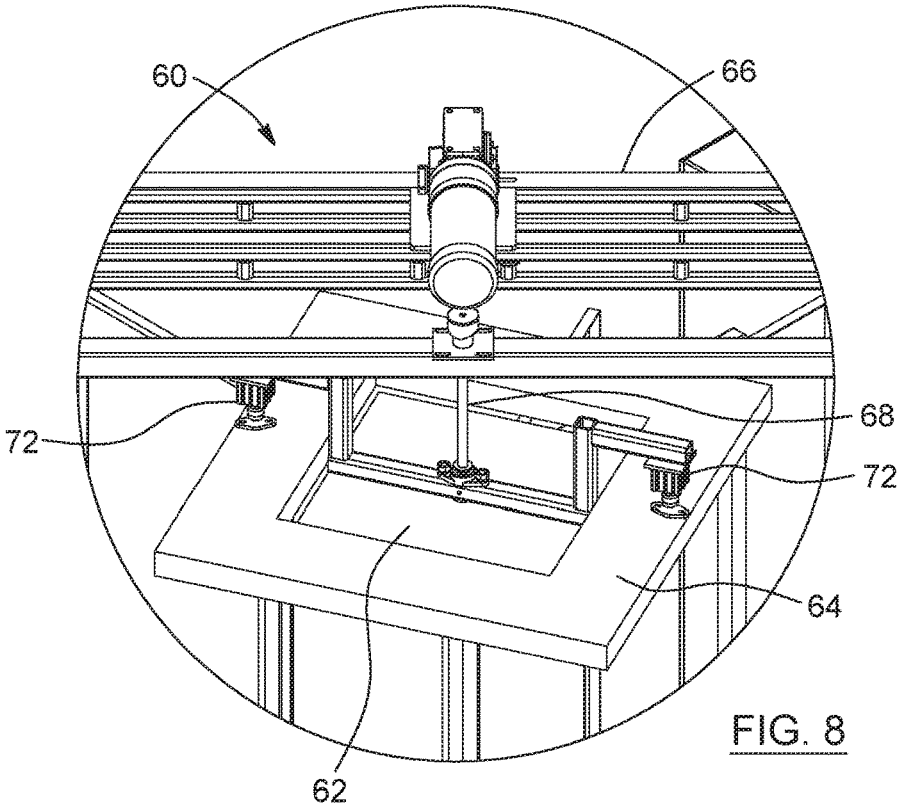
FIG. 8 is a perspective view, partly sectioned and enlarged, of a dual stage top press of the wrapping apparatus shown in FIG. 1 in accordance with an embodiment.
Figure 9:
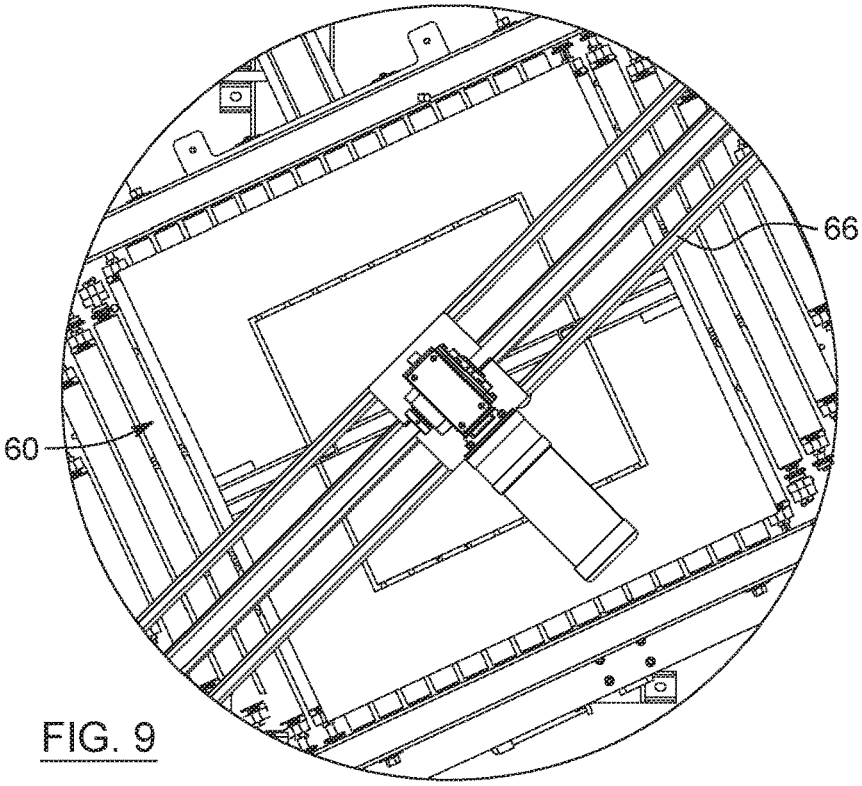
FIG. 9 is a top plan view, partly sectioned, of the dual stage top press shown in FIG. 8.

Referring now to FIGS. 8 and 9, there is shown that the wrapping apparatus 20 is also provided with a top press 60 and, more particularly, a dual stage top press 60 positioned above the turntable 24 for securing a load thereon by applying pressure. The top press 60 has a central (or inner) press 62 and a peripheral (or outer) press 64 which can operate independently of one another, if required. The top press 60 provides stability by countering the centrifugal forces generated when the load is being wrapped through rotation. These centrifugal forces may result in the load being spun out, or ejected from, the wrap zone 48 or the turntable 24. The peripheral press 64 can surround the central press 62. The central press 62 and the peripheral press 64 are actuatable independently of each other, as it will be described in more detail below.

The dual stage top press 60 is mounted to a frame 66 which extends vertically above the turntable 24 and the load being wrapped. In the embodiment shown, the frame 66 includes a main actuator 68 mounted to the frame 66 and connected to the central press 62. The main actuator 68 applies a force which displaces the central press 62 between an operative configuration wherein the central press 62 applies pressure on the upper surface of the load located on the turntable 24, and a disengaged configuration wherein the dual stage top press 60 is spaced-apart from the load.

The central press 62 and the peripheral press 64 are connected to one another through a pneumatic actuator 72, i.e. the peripheral press actuator, which is actuatable independently of the main actuator 68. Therefore, the peripheral press 64 can be configured in an operative configuration wherein the peripheral press 64 applies pressure on the upper surface of the load located on the turntable 24, and in a disengaged configuration wherein the peripheral press 64 is spaced-apart from the load. These configurations of the peripheral press 64 allow for the peripheral region of the upper surface of the load to be wrapped.

Thus, when wrapping a load, the central press 62 is configured in the operative configuration and maintains a substantially constant hold in the center of the load. The peripheral press 64 is selectively configurable in the operative and disengaged configurations. When wrapping the lateral walls of the load, the peripheral press 64 is configured in the operative configuration and applies a hold on the peripheral portion of the upper surface of the load. When wrapping the upper portion of the lateral walls and the peripheral portion of the upper surface of the load, the peripheral press 64 is configured in the disengaged configuration, and is spaced-apart from the upper surface of the load.

Thus, the optionally pneumatic actuator 72 connecting the central and peripheral presses 62, 64 allows for maintaining a substantially constant hold in the center of the load and while still permitting the peripheral press 64 to be lifted off the top periphery of the load so as to allow for film overwrap. This allows for wrapping at least a portion of the top of the load while maintaining load stabilization.

One skilled in the art will appreciate that the top press 60 can have more than two sections, i.e. more than the central and the peripheral press sections 62,64. Furthermore, the shape and the configuration of the press sections 62,64 can differ from the embodiment shown in the attached drawings. Furthermore, each press section 62,64 can have its own actuator and the actuators of the press sections 62,64 can be independently actuable.

Moreover, although the embodiments of the wrapping apparatus 20 and corresponding parts thereof consist of certain geometrical configurations as explained and illustrated herein, not all of these components and geometries are essential to the invention and thus should not be taken in their restrictive sense. It is to be understood, as also apparent to a person skilled in the art, that other suitable components and cooperation therein between, as well as other suitable geometrical configurations, may be used for the wrapping apparatus according to the present invention, as it will be briefly explained herein and as can be easily inferred here from by a person skilled in the art. Moreover, it will be appreciated that positional descriptions such as "above", "below", "left", "right" and the like should, unless otherwise indicated, be taken in the context of the figures and should not be considered limiting.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

The invention claimed is:

1. A wrapping apparatus for wrapping a load having an upper surface, the wrapping apparatus comprising a load press having:

a central press section having a load contact surface and being configurable in an operative configuration wherein the load contact surface of the central press section abuts the upper surface of the load, and in a disengaged configuration wherein the load contact surface of the central press section is spaced-apart from the load; and a peripheral press section at least partially surrounding the central press section, having a load contact surface, and being configurable in an operative configuration wherein the load contact surface of the peripheral press section abuts the upper surface of the load, and in a disengaged configuration wherein the load contact surface of the peripheral press section is spaced-apart from the upper surface of the load; the central press section and the peripheral press section being independently configurable in the operative and disengaged configurations and the load contact surfaces of the central and peripheral press sections extending substantially parallel to one another when configured simultaneously in their respective operative configurations.

2. The wrapping apparatus as claimed in claim 1, wherein the load press further comprises a frame extending above the upper surface of the load and at least one main actuator mounted to the frame and operatively connected to at least one of the central press section and the peripheral press section for configuring the at least one of the central press section and the peripheral press section in the operative and disengaged configurations.

3. The wrapping apparatus as claimed in claim 2, wherein the at least one main actuator is operatively connected to the central press section and is actuable for selectively configuring the central press section in the operative and disengaged configurations.

4. The wrapping apparatus as claimed in claim 1, wherein the load press further comprises a peripheral press actuator connecting the central press section and the peripheral press section together and actuable for selectively configuring the peripheral press section in the operative and disengaged configurations when the central press section is configured in the operative configuration.

5. The wrapping apparatus as claimed in claim 4, wherein the peripheral press actuator actuates the peripheral press section in the disengaged configuration, thereby spacing the peripheral press section apart from the upper surface of the load, and further actuates the central press section in the operative configuration while the upper surface of the load is at least partially wrapped.

6. A method for wrapping an upper surface of a load with the wrapping apparatus claimed in claim 1, the method comprising:

configuring the central press section and the peripheral press section in the operative configuration wherein the load contact surfaces of the central press section and the peripheral press section abut the upper surface of the load;

wrapping a first section of the load;

configuring the peripheral press section in the disengaged configuration wherein the peripheral press section is spaced-apart from at least a part of the upper surface of the load; and wrapping a second section of the load, the second section including at least a part of the upper surface of the load.

7. The method as claimed in claim 6, wherein wrapping the load comprises rotating the load about itself.

8. The wrapping apparatus as claimed in claim 1, wherein the central press section and the peripheral press section are concentric.

9. The wrapping apparatus as claimed in claim 1, wherein the load contact surfaces of the central and peripheral press sections extend substantially in a same plane when configured simultaneously in their respective operative configurations.

* * * * *